US008113613B2

(12) United States Patent
Folkers et al.

(10) Patent No.: US 8,113,613 B2
(45) Date of Patent: Feb. 14, 2012

(54) SYSTEM AND METHOD FOR MAINTAINING OR RECOVERING NOZZLE FUNCTION FOR AN INKJET PRINTHEAD

(75) Inventors: John P. Folkers, Palatine, IL (US); Charles W. Gilson, Philomath, OR (US); Thomas E. Kimerling, Corvallis, OR (US); Terry M. Lambright, Corvallis, OR (US); Francis Chee-Shuen Lee, Hsin-Chu (TW); Mark R. Thackray, Corvallis, OR (US); Kenneth E. Trueba, Corvallis, OR (US); Christopher Cocklan, Clarendon Hills, IL (US); Casey Robertson, Romeoville, IL (US); Anthony Selmeczy, West Chicago, IL (US); Charles C. Haluzak, Philomath, OR (US)

(73) Assignee: Videojet Technologies Inc.

( * ) Notice: Subject to any disclaimer, the term of this patent is extended or adjusted under 35 U.S.C. 154(b) by 422 days.

(21) Appl. No.: 12/432,863

(22) Filed: Apr. 30, 2009

(65) Prior Publication Data

US 2009/0273621 A1 Nov. 5, 2009

Related U.S. Application Data

(60) Provisional application No. 61/049,490, filed on May 1, 2008.

(51) Int. Cl.
*B41J 29/38* (2006.01)

(52) U.S. Cl. ..... 347/9

(58) Field of Classification Search ..... None
See application file for complete search history.

(56) References Cited

U.S. PATENT DOCUMENTS

| | | | | |
|---|---|---|---|---|
| 4,370,662 | A | 1/1983 | Hou et al. | |
| 4,600,928 | A | 7/1986 | Braun et al. | |
| 4,849,769 | A | 7/1989 | Dressler | |
| 5,023,625 | A * | 6/1991 | Bares et al. | 347/48 |
| 5,168,284 | A | 12/1992 | Yeung | |
| 5,329,293 | A | 7/1994 | Liker | |
| 5,475,405 | A | 12/1995 | Widder et al. | |
| 5,541,628 | A | 7/1996 | Chang et al. | |
| 5,600,354 | A * | 2/1997 | Hackleman et al. | 347/50 |
| 5,751,302 | A | 5/1998 | Rezanka | |
| 5,757,396 | A * | 5/1998 | Bruner | 347/27 |
| 6,183,057 | B1 | 2/2001 | Sharma et al. | |
| 6,213,587 | B1 | 4/2001 | Whitman | |
| 6,250,740 | B1 * | 6/2001 | Moghadam et al. | 347/48 |
| 6,286,929 | B1 | 9/2001 | Sharma et al. | |
| 6,350,007 | B1 | 2/2002 | Meichle et al. | |
| 6,412,901 | B2 | 7/2002 | Su et al. | |
| 6,422,684 | B1 | 7/2002 | Ladabaum et al. | |
| 6,431,674 | B2 * | 8/2002 | Suzuki et al. | 347/10 |
| 6,695,441 | B2 * | 2/2004 | Asano | 347/86 |

(Continued)

FOREIGN PATENT DOCUMENTS

JP 57061576 4/1982

*Primary Examiner* — Stephen Meier
*Assistant Examiner* — Tracey McMillion
(74) *Attorney, Agent, or Firm* — Joseph A. Yosick

(57) ABSTRACT

A transducer capable of generating vibrational energy is positioned relative to an inkjet cartridge to impart a vibrational force to simultaneously vibrate at least a portion of each of a plurality of ink fluidic columns associated with a plurality of nozzles in a printhead of the inkjet cartridge to maintain or recover nozzle function.

37 Claims, 6 Drawing Sheets

U.S. PATENT DOCUMENTS

| | | | | |
|---|---|---|---|---|
| 6,761,423 | B2 | 7/2004 | Ozaki et al. | |
| 2003/0081033 | A1* | 5/2003 | Giere et al. | 347/17 |
| 2005/0024444 | A1* | 2/2005 | Conta et al. | 347/65 |
| 2007/0052779 | A1 | 3/2007 | Cho | |
| 2008/0018691 | A1* | 1/2008 | Koase | 347/19 |

* cited by examiner

SYSTEM AND METHOD FOR MAINTAINING OR RECOVERING NOZZLE FUNCTION FOR AN INKJET PRINTHEAD

CROSS-REFERENCE TO RELATED APPLICATIONS

This application claims benefit of U.S. Provisional Application No. 61/049,490 filed May 1, 2008, and incorporated herein by reference in its entirety.

BACKGROUND OF THE INVENTION

The present invention relates generally to inkjet printheads for inkjet printers wherein the printhead includes a plurality of nozzles in fluid communication with an ejection chamber, and ink is ejected from the chamber through the nozzles in drops for printing on a medium. More specifically, this invention pertains to systems or methods for maintaining or recovering nozzle function affected by ink clogging at the nozzles An inkjet printhead for an inkjet printing system includes a plurality of nozzles through which ink is ejected in drops responsive to printing commands from a controller for printing on a print medium. Whether the printhead is of the type that is permanently mounted on a printing system and linked to an ink source or of a disposable nature that includes a cartridge supporting an ink reservoir, each of the nozzles is disposed on the printhead in fluid communication with an ink ejection chamber. In the case of thermal ink jet printers and printheads, ink is ejected in drops by the application of heat to ink in the ejection chamber responsive to the printing commands. One or more resistive heater is associated with each ejection chamber and generates heat that causes solvents in the ink to vaporize generating bubble in the ejection chamber. The rapid expansion of the bubbles forces ink through the nozzles in drop form.

Other types of printing systems and printheads have a piezoelectric transducer integrated in the printhead forming a wall in the ink ejection chamber, or in some other chamber that that holds ink and is in fluid communication with the ejection chamber. Responsive to printing commands the wall, or the piezoelectric transducer, expands and contracts forcing ink from the ejection chamber in droplet form for printing.

In either of the above-described inkjet printheads, the ink solvent may tend to evaporate at the nozzles causing the ink at or in the nozzles to become more viscous when the printhead and nozzles are not performing a printing operation. More viscous ink at the nozzle area tends to plug the nozzle directly affecting the performance of the printhead and printing quality. Some systems or methods for maintaining or restoring nozzle function include capping the nozzle plate, wiping the printhead with an elastomeric blade and spitting ink through the nozzles, all of which are performed when the printhead is not performing a printing operation.

Printing systems incorporating such methods typically include printheads that move back and forth on a carriage during printing operations, and the printheads are moved to a station when printing operations are stopped or suspended. Capping the nozzle prevents fluid evaporation in the nozzles and the formation of the viscous plug. Wiping the nozzle plate with the elastomeric blade clears the nozzles of the viscous plugs and dried ink residue. Spitting processes flush ink from the nozzle to clear the fluidic column of viscous ink in the nozzle including the ejection chamber. However, such processes can not be practically used in printing systems for which a printhead remains stationary during printing and does not move on a carriage during printing. Wiping or spitting methods can foul the printing medium and area surrounding a print area. In production line printing for printing bar codes, dates or other data on product packaging, the wiping and spitting techniques may interrupt a production line. In addition, the printheads for stationary printing systems in some instances are positioned so close to the print medium a cap is difficult to place on the nozzle plate.

The wiping and spitting processes may be effective for clearing the nozzles of the viscous plugs, but are inherently wasteful because ejected ink is not used for printing. In addition, printing systems monitoring an ink volume available for printing by counting ink drops ejected from the printhead may not factor ink used during cleaning operations. Accordingly, a remaining volume of ink may be over estimated and an ink cartridge may be commanded to perform printing operations with an insufficient amount of remaining ink to perform or complete a printing operation. This may lead to dry firing at the nozzles of the printhead, which may damage the printhead. In addition, an over-estimation of remaining ink volume may result in the printing system missing codes or prints on the packaging in production line printing.

Both U.S. Pat. No. 5,329,293 and JP 57061576 disclose printheads incorporating piezoelectric elements activated to discharge ink drops for printing responsive to a first signal from a controller. A second sub-firing, or voltage signal that is below a threshold voltage signal required for discharging ink, activates the piezoelectric elements to prevent clogging of ink in the nozzle. In addition, U.S. Pat. No. 6,431,674 (the "'674 patent") discloses an inkjet printhead that minutely vibrates an ink meniscus at nozzle openings before or after a printing operation to prevent clogging of the printhead nozzles. More specifically, the '674 patent discloses an inkjet printhead of the type that utilizes the above-described piezoelectric transducers and ejection chambers, referred to as a pressure generating chamber. The printhead includes a plurality of the pressure generating chambers wherein each chamber is associated with a nozzle and each chamber has its own transducer. The piezo-transducers are activated to pressurize their respective chambers to eject ink drops from the chamber for printing. In addition, during printing inactivity, each piezo-transducer may pressurize their respective chamber to vibrate the meniscus to an extent insufficient to eject an ink drop. Because the transducer is used to pressurize the chamber for both ejecting ink and minutely vibrating the meniscus, the transducer is activated for a plurality of successive timed intervals to avoid fatiguing the transducer.

Such above-described piezo-transducer systems can not be practically incorporated in thermal inkjet printheads. Incorporating a piezoelectric transducer for each print cartridge would be cost prohibitive for manufacturing thermal inkjet cartridges or printheads. In addition, the resistive heaters incorporated in thermal inkjet printheads may not practically be used to oscillate the meniscus without ejecting ink as compared to the piezoelectric ink ejection technologies. In thermal inkjet printheads, a voltage is applied to a resistive heater associated with each firing chamber and nozzle and heats the ink in the firing chamber causing the rapid expansion of an ink bubble forcing an ink drop through the nozzle. A threshold voltage at which an ink drop may or may not be ejected from a thermal inkjet printhead is far less predictable as compared to the piezo-transducer inkjet printheads. Indeed, in printing systems incorporating thermal inkjet printheads an algorithm is used to estimate the voltage necessary to discharge ink drops. The algorithm considers such parameters such as physical properties (vapor pressure) of the ink used and dimensions of the ink channels, firing chambers and nozzles. Once the threshold voltage is determined, the algorithm is configured to select a voltage that is a predetermined percentage over the calculated threshold to ensure that ink drops will be ejected when voltage signals are applied to the resistive heaters. Application of voltage at or below a threshold voltage may or may not oscillate a meniscus, or it may cause an ink discharge. In addition, heating the ink in a firing chamber when printing has stopped or been suspended may cause ink in the firing chamber to dry and clog the nozzles.

BRIEF DESCRIPTION OF THE INVENTION

A system or method for maintaining nozzle function for an inkjet printing system comprises a printhead in fluid communication with an ink supply, and for printing on a print medium. The printhead has a plurality nozzles and each nozzle is associated with an ink ejection chamber in which ink is stored for ejecting ink drops from the chamber through the nozzle. An ink fluidic column is associated with each nozzle and may comprise an ink meniscus formed at the one or more nozzles and ink in the ejection chambers. In order to maintain or recover nozzle function in the cartridge, a transducer is provided for transmitting vibrational energy to the fluidic column to simultaneously vibrate at least a portion of each of a plurality of the ink fluidic columns. The transducer is linked to a controller of the printing system, which controller generates a signal to activate the transducer during the periods of printing inactivity or during printing operations. In an embodiment the printhead is mounted on a cartridge and vibrational energy may be transmitted to the fluidic column from a location external of the cartridge. In other embodiments, a transducer may be mounted internally in a cartridge housing, or may be provided as a component of a printhead circuit.

In an embodiment, an inkjet cartridge is mounted in a pocket that has walls configured for receiving and holding the cartridge in spaced relation to the print medium for printing. A vibrational force may be applied to a wall of the pocket and the interface between pocket wall and cartridge surface couple the vibrational energy to the printhead. In another embodiment, the vibrational force may be applied directly to the exterior surface of the cartridge. In this manner, the vibrational energy is transmitted to a fluidic column in the printhead to vibrate the fluidic column to maintain or recover nozzle function.

DETAILED DESCRIPTION OF THE INVENTION

Figure 1:
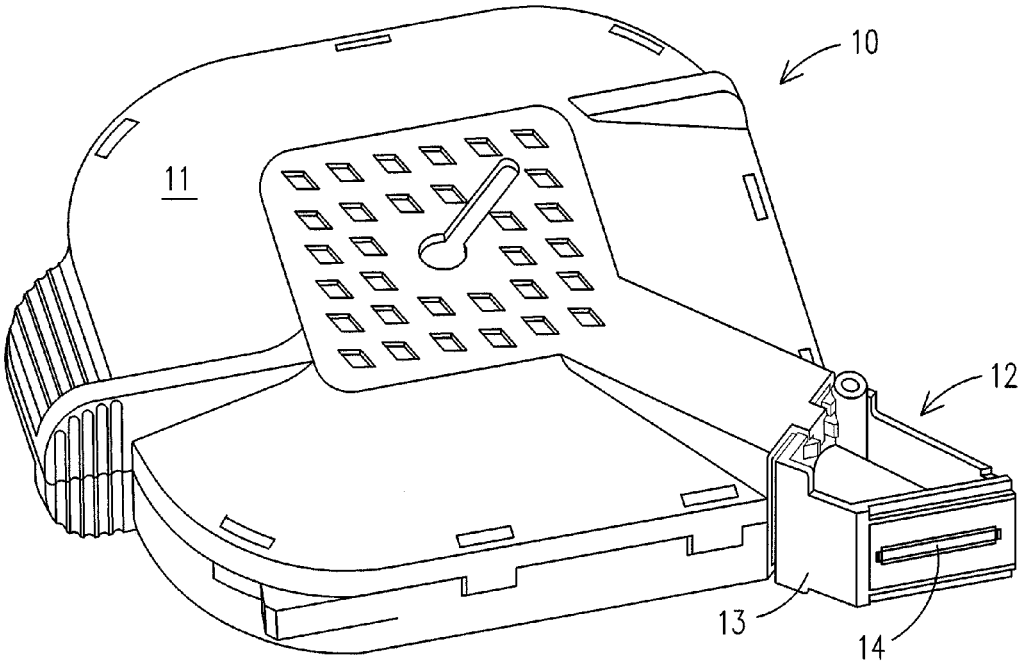
FIG. 1 is a perspective view of an inkjet cartridge.

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained. For purposes of describing embodiments of the present invention, references in the drawings and specification are made to a printhead for a thermal inkjet cartridge; however, the invention is not so limited. The present invention may be used with inkjet cartridges that incorporate means other than heat to eject ink drops from the printhead. For example, the described invention may be used for those cartridges that incorporate piezoelectric transducer technologies to eject ink drops for printing or other operations. In addition, the described system and method for maintaining or recovering nozzle function is not limited to application with a printhead assembly mounted to a cartridge housing as shown in FIG. 1, which may or may not be a disposable cartridge. The present invention may be used with printheads permanently mounted in printing systems and an ink supply is provided as necessary for printing. So the term cartridge may include a permanently mounted printhead only and/or the combination of the printhead with the ink source. Vibrational energy as used here may include a continuous application of vibrational energy or vibrational energy applied in periodic bursts, pulses or cycles or applied as a single or repetitive waveform.

With respect to FIG. 1, an inkjet cartridge 10 is illustrated having a housing 11 within which an ink reservoir (not shown) is secured, which reservoir holds a bulk ink source. A printhead assembly 12, attached to the housing 11, includes a printhead 14 mounted to a snout 13 whereby the printhead 14 is in fluid communication with the ink reservoir. The term snout as used herein refers to that component of the cartridge 10 on which the printhead 14 is mounted and typically comprise an extension of the cartridge housing 11 that is adapted for interconnection with the printing system to register the printhead for printing. The snout 13 shown in FIG. 1 is a separate component attached to the cartridge housing 11; however, the snout 13 may be integrally formed with the housing 11. In addition, the invention is not limited to a printhead mounted to a snout such as those permanently mounted printheads that may receive ink from an off-axis source. In such a case, the cartridge 10 may not have a snout; and the printhead assembly may include the printhead and the surface to which the printhead is attached.

The term printhead as used herein shall include that component of the ink cartridge 10 to which ink is supplied from a bulk ink source for ejection of ink drops. In the embodiments described herein for a thermal inkjet cartridge, the printhead 14 may comprise a silicon substrate 15 with an ink slot 16, fluidic channels 17, firing chambers 18, nozzles 22 and the necessary integrated circuitry formed thereon and the nozzle plate 23. In other types of printheads that do not have an ink slot for example, the printhead comprises the ejection, pressure or firing chambers adjacent to the nozzles and the structural parts that define these components. In addition, at least for those inkjet cartridges utilizing piezoelectric technologies, the printhead also includes the piezo-elements integrated with the printhead for generating ink drops.

Figure 2:
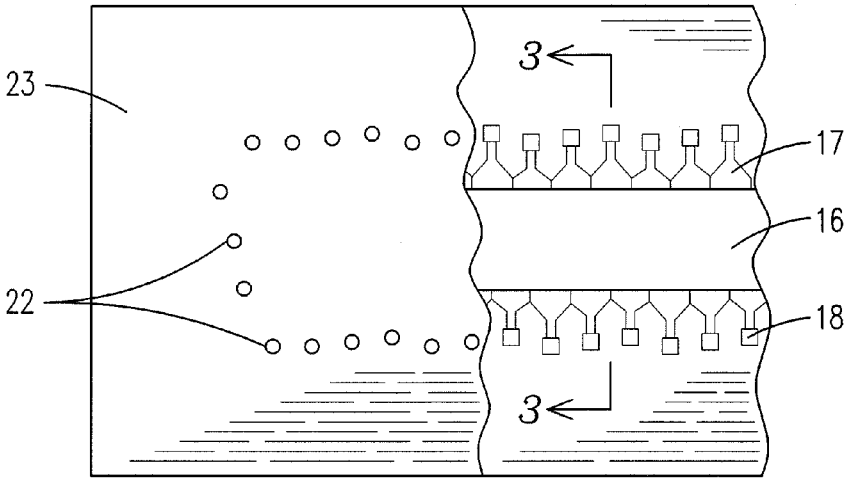
FIG. 2 is a partial elevational view of a printhead illustrating an arrangement of nozzles and firing chambers for the printhead.
Figure 3:
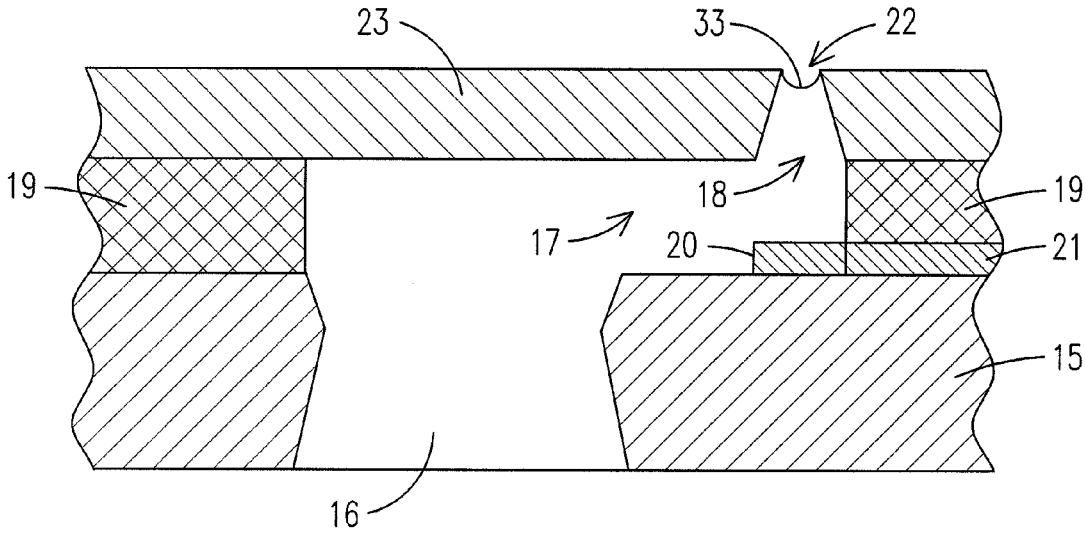
FIG. 3 is a schematic sectional view of the printhead in FIG. 2 showing a meniscus formed in a nozzle.

In FIGS. 2 and 3, there is illustrated in more detail components of the printhead 14 for a thermal inkjet cartridge. More specifically the printhead 14 includes a substrate on which components such as resistive heaters 20 and transistors 21 are formed along with other components of an integrated circuit such as passivation layers, interdielectric layers, insulating layers, bonding pads, identification circuits etc. An ink barrier layer 19 covers the components 20 and 21 and other areas of the substrate and is etched, or otherwise fabricated to form the firing chambers 18 and fluid channels 17. Each of the fluid channels 17 is positioned in fluid communication with an ink slot 16 centered on the printhead 14. In this manner, ink from the bulk source in the cartridge 10 is provided to the firing chambers 18 via the ink slot 16 and respective fluid channels 17. Note, the above-described printhead 14 is provided by way of example for describing the subject invention, and is not limited to the described embodiment. For example, some thermal inkjet printheads do not include an ink slot. Instead, ink is supplied from an ink source along edges of the printhead to the ejection chambers. In addition, not all printheads have the transistors integrated on the printhead circuitry, which may be incorporated in the printing system controller.

A nozzle plate 23 is bonded to the barrier layer 19 and has a plurality of nozzles 22 each of which corresponds to a respective firing chamber 18. Ink provided from the bulk source via the ink slot 16 forms an ink fluidic column including ink at nozzles 22 and ink in the firing chamber 18, fluidic channel 17 and ink slot 16. A negative pressure is generated and maintained at the ink bulk source forming a meniscus 33 (shown in FIG. 3) at the nozzle 22 to prevent ink from oozing from the printhead 14 when the printhead 14 is not performing printing operations. Note, that the subject invention is not limited to the use of a cartridge that includes a mechanism for generating a negative pressure in the ink supply thereby forming the meniscus. Those skilled in the art will appreciate that menisci may be formed without such mechanisms.

Figure 4:
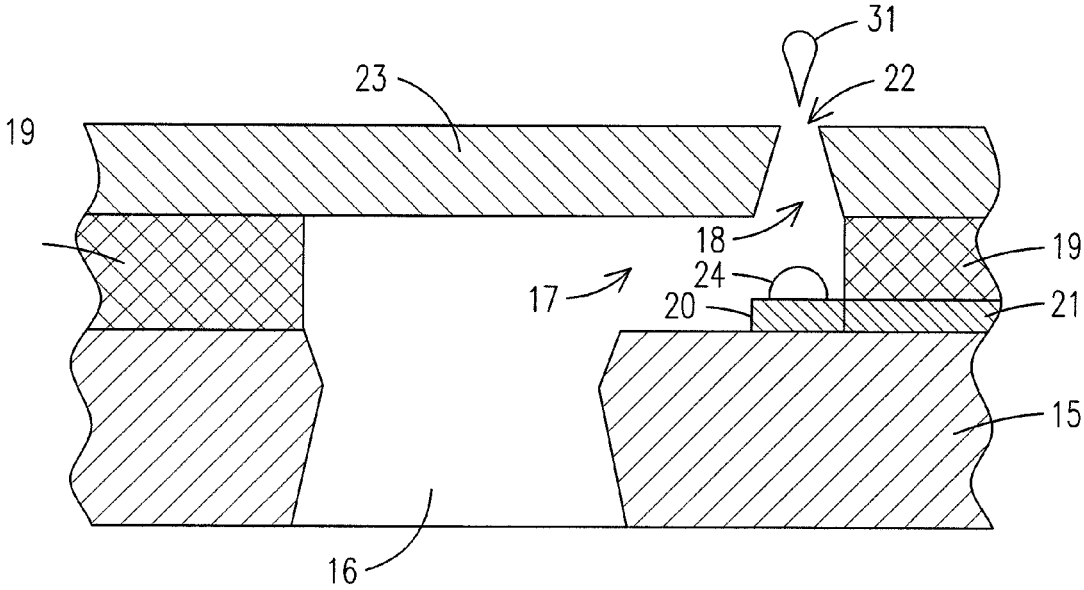
FIG. 4 is a schematic sectional view of a printhead showing an expanding inkjet bubble and an ink drop ejected through a nozzle.

For each firing chamber 18 there is a corresponding resistive heater 20. Responsive to a print command from the controller, a power supply to the resistive heater 20 causes the heater 20 to heat ink in the firing chamber 18. As represented schematically in FIG. 4, rapidly expanding bubbles 24 in the ink firing chamber 18 force ink drops 31 through nozzle 22 responsive to print commands from a controller 29 (shown in FIG. 5). However, during time intervals of printing inactivity, the ink may dry or solvents in the ink may evaporate causing the ink to increase in viscosity at the nozzle 22, plugging the nozzles 22. When printing is initiated the nozzles 22 may not fire until after an elapsed time, directly affecting print quality produced by the cartridge 10 and printing system.

With respect to the present invention, nozzle function is maintained or recovered for an inkjet cartridge by transmitting vibrational energy, preferably via sonic or ultrasonic energy, from external source through an exterior of the inkjet cartridge to the fluidic column to vibrate or oscillate the fluidic columns and/or the menisci 33 at a plurality of nozzles 22. For purposes of convenience of explanation of the invention the term sonic energy (<20 kHz) as used herein shall include ultrasonic energy (>20 kHz) both of which induce an oscillation or vibration of ink in at least a portion of the fluidic column. The fluidic column as used herein shall include the ink present between the ink bulk supply and the nozzle 22, or ink at or in the nozzle 22 and ink ejection chamber 18. In the present example described herein, the fluidic column comprises the ink present in the nozzle 22 (including the meniscus 33), the firing chamber 18, fluid channel 17 and the ink slot 16. The rapid vibration or oscillation of the fluidic column maintains the ink composition and properties by replenishing ink solvent in the fluidic column and preventing ink crusting that may plug or clog the nozzle.

Figure 6:
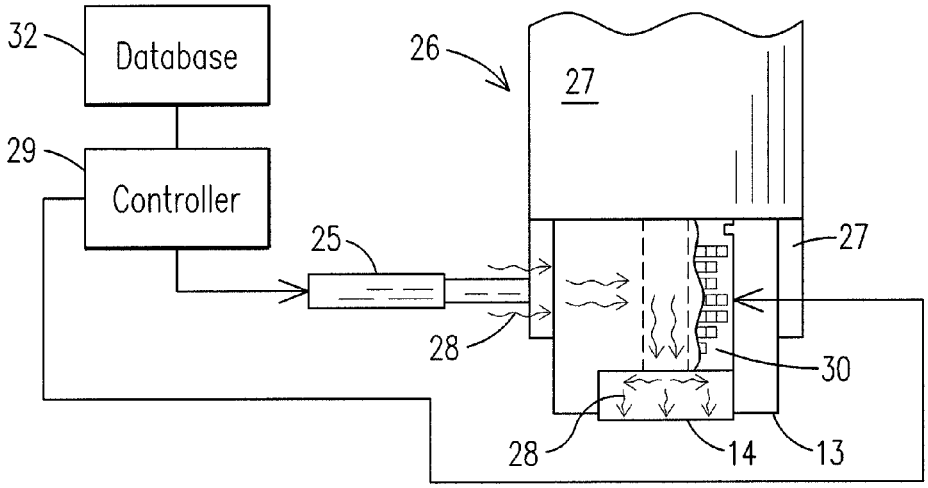
FIG. 6 is an elevational schematic view of the inkjet cartridge positioned in a printing system pocket including a schematic illustration of a transducer applying a vibrational force to the cartridge and printhead.
Figure 5:
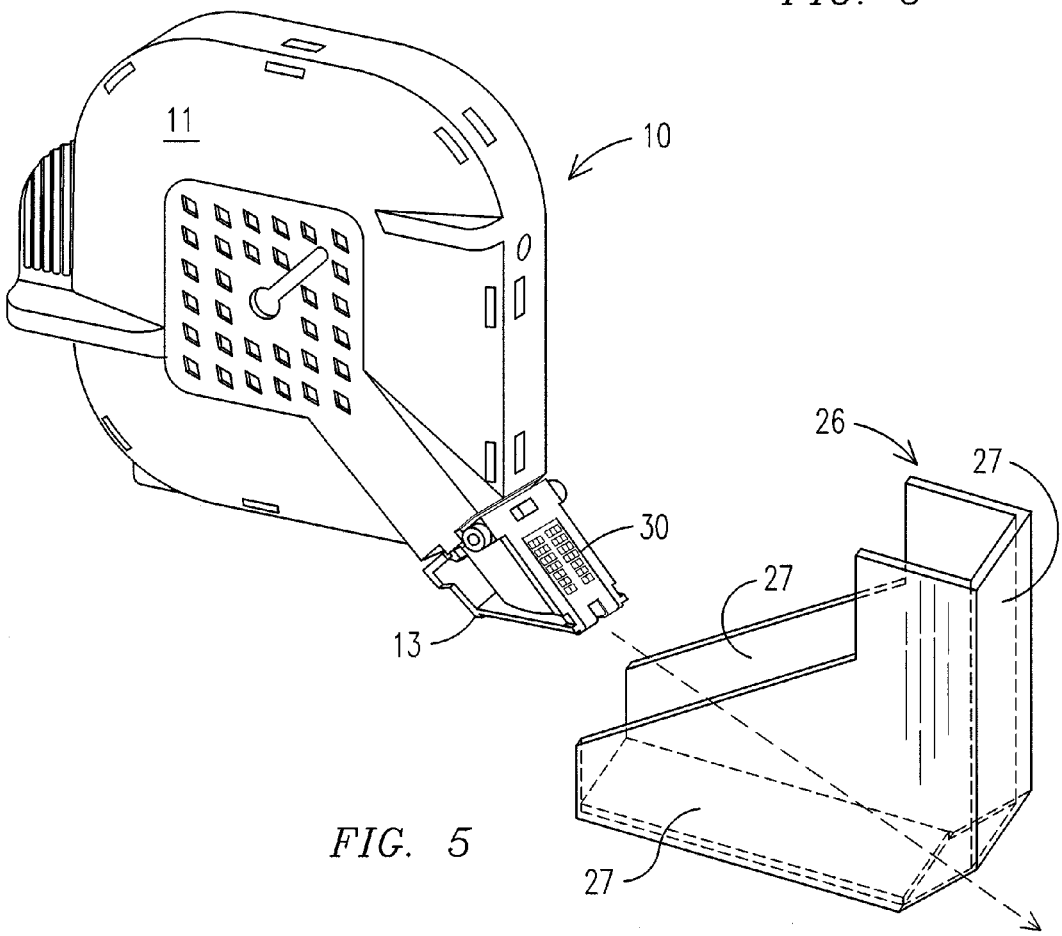
FIG. 5 is a perspective exploded view of an inkjet cartridge aligned for positioning in a pocket of a printing system.

With respect to FIGS. 5 and 6 there is shown an inkjet cartridge 10 and a pocket 26 of a printing system for receiving and holding the cartridge 10 in spaced relation to a print medium for printing. In an embodiment, the printing system may be of the type in which the cartridge 10 remains stationary as a print medium passes by the printhead 14 for printing operations. The printhead 14 is electronically linked with a controller 29 via the electrical interconnect 30 on the snout 13 for receiving print commands for printing on the medium passing the printhead 14. A transducer 25 is positioned relative to the cartridge 10 or the pocket 26 to impart a vibrational force to an exterior of the cartridge 10 in order to vibrate the ink in the fluidic columns of the printhead 14. The application of this vibrational force, or transmission of vibrational energy, may take place during time periods of printing inactivity or during printing operations, or continuously during periods of printing inactivity and during printing operations, to prevent the ink from becoming viscous to a state of clogging the nozzle, or for recovering nozzle function due to clogging. In addition, although embodiments illustrated and described here show a transducer applying a vibrational force to an exterior of the cartridge, embodiments may also include a transducer mounted to the cartridge internally (for example, in the snout area), and/or a transducer integrated as a component of the printhead.

The transducer 25 may be positioned on the printing system so that that transducer 25 imparts the vibrational force to the pocket 26. The transducer 25 may be positioned in contact with pocket 26 or an exterior of the cartridge 10 to impart the vibrational force at a frequency or within a range of frequencies necessary to vibrate or oscillate the fluidic column and/or meniscus 33 without ejecting ink drops. As shown in FIGS. 5 and 6, pocket 26 may include a plurality of interconnected and/or spaced apart walls 27 for receiving the cartridge 10 and/or snout 13, and the transducer 25 is placed in contact with one of the walls 27. The interface between the pocket wall 27 and cartridge 10 and/or snout 13 provides a coupling path represented by arrows 28 from the transducer 25 to the nozzles 22. In addition, the interface between the pocket 26 and the cartridge 10 and/or snout 13 should be sufficiently snug to minimize movement of the cartridge 10 in the pocket 26 during activation of the transducer 25. Accordingly, the cartridge 10 and/or snout 13 may include one or more datum surfaces that are positioned in mating relationship with receiving surfaces in the pocket 26. The transducer 25 may be any piezoelectric transducer or other transducers that may generate sonic or ultrasonic energy at acceptable frequencies.

In addition, the composition of the materials making up the pocket 26, cartridge housing 11 and the snout 13 should be considered in application of this system and method. More specifically, materials composition of these components should provide an adequate coupling of the vibrational forces or energy generated by the transducer 25 to the fluidic column. For examples a metal such as steel or a glass-filled plastic such as polyethylene terephthalate, or a combination of the two may provide an adequate coupling.

The point at which the transducer 25 contacts the pocket 26, or cartridge 10, relative to the printhead 14 and nozzles 22, the frequency or range of frequencies or amplitude or range of amplitudes necessary to oscillate or vibrate the ink in the fluidic column and at the nozzles 22 may vary among cartridge types. Variables or parameters to consider when determining a contact point or energy frequency may comprise the material composition of the cartridge housing 11, snout 13 and pocket 26; the architecture of the components of the fluidic column comprising the dimensions of the ink slot 16, fluidic channel 17, firing chamber 18 and nozzles 22; and, properties of the ink namely ink viscosity may be taken into consideration. In addition, ink properties may be considered in determining the frequency or amplitude of the vibrational energy or the area of application of the transducer 25. Such ink properties may include the dry time of the ink (amount of time necessary for the ink to dry at the nozzle), the ink viscosity and the sound velocity (speed at which sound may travel through an ink medium).

In addition, these parameters may also influence the time duration required for application of sonic vibration or energy, which in turn may be influenced by the time duration of a period of printing inactivity or a printing operation For example, taking into consideration the above-described parameters, it may be determined that a vibrational force should be applied to the inkjet cartridge 10, if a printing system has not performed a printing operation for an elapsed predetermined time duration T1, where the vibrational force is applied for a predetermined time duration T2 to maintain nozzle function. The controller 29 may be programmed to generate a signal to activate the transducer 25 once the time duration T1 has elapsed. The transducer 25 may remain activated until the controller 29 generates another print command in order to maintain nozzle function. Alternatively, the controller 29 may generate multiple signals to activate the transducer 25 in spaced time intervals during a period of inactivity or during printing in order to maintain nozzle function of the cartridge 10.

These above-listed parameters are provided as examples of parameters that may be considered and are not intended to provide an exhaustive list. Indeed, the contact point for the transducer 25 and ink oscillating frequency may have to be determined for individual cartridges or cartridge types empirically. To that end, for types of cartridges having similar physical properties that are filled with the same or similar inks, the location of the transducer contact point and the ink oscillating or vibrating frequency may be predicted and refined.

With respect to the present invention testing was conducted in both a nozzle maintenance mode and a nozzle recovery mode. The nozzle maintenance mode includes those time intervals of printing inactivity when a cartridge may be exposed to sonic excitation to prevent ink from drying or become more viscous to a point of plugging the nozzles 22. A recovery mode may involve an extended time interval of printing inactivity that results in the ink drying or becoming more viscous to the point of plugging the nozzles.

Figure 7:
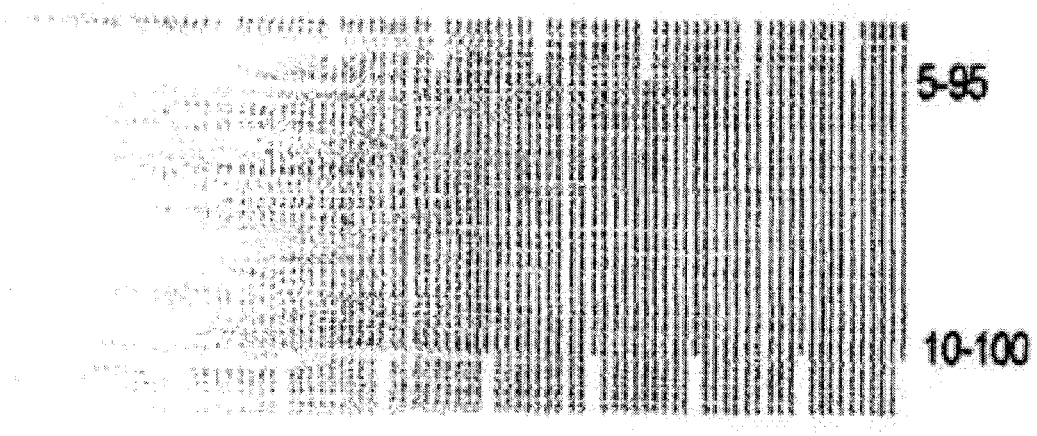
FIG. 7 is a photograph of printed columns generated using a test inkjet cartridge that remained uncapped for a fifteen minute time period of printing inactivity.

Comparison testing was conducted by allowing a cartridge filled with a methyl ethyl ketone (MEK)/methanol solvent-based ink (Videojet Product No. D6-5614) and allowed to remain uncapped for a period of fifteen minutes without sonic excitation. In reference to a sample of the testing, an HP45A thermal inkjet cartridge having a similar integral snout configuration as shown in FIG. 5 was utilized. The cartridge 10 and snout 13 were composed of a glass-filled plastic material; and, the pocket 26 was composed of a steel alloy. After the elapsed time of fifteen minutes, printing was initiated and the vast majority of the nozzles did not fire ink drops until after printing began. In reference to FIG. 7, there is shown a photograph of printed image including print columns. A majority of the nozzles in the test cartridge, printing at a frequency of 1 kHz, did not begin firing until approximately the forty-sixth column was printed.

Figure 8:
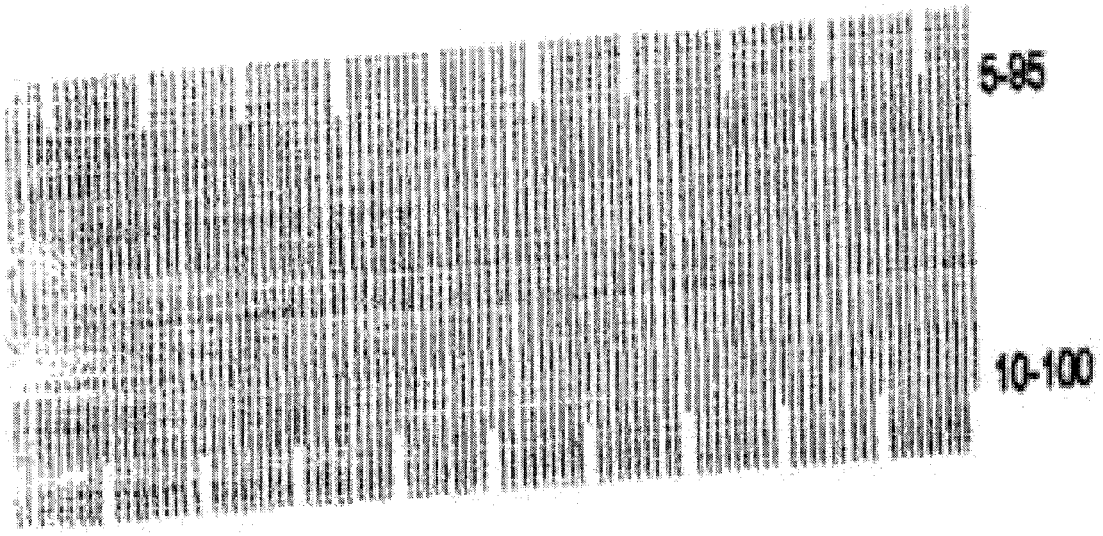
FIG. 8 is a photograph of printed columns generated using the identical test cartridge used to print the columns in FIG. 6, after the test cartridge was exposed to sonic excitation.

The identical cartridge was then exposed to sonic excitation during another fifteen minute period. A piezoelectric transducer was activated to apply a sonic vibrational force for the duration of the fifteen minute period of printing inactivity. The piezoelectric transducer 25 was placed in contact with the pocket 26 at an area adjacent the snout 13 about 1½" above the printhead 14. In reference to FIG. 8, there is shown a photograph of a printed image including print columns produced by the cartridge after having been exposed to sonic excitation. A majority of the nozzles in the test cartridge printing at a frequency of 1 kHz began firing and printing at the first column.

In other testing, nozzles on the printhead of the HP45A were observed with a video system using a strobed illumination source to observe the motion of ink meniscus in the nozzle. An HP45A inkjet cartridge as described above filled with the VideoJet Product No. D6-5614 ink was allowed to sit decappped for 15 minutes without sonic excitation, and a dried film on the nozzles was easily observed with the video system. Upon application of sonic energy to the cartridge, the crusted nozzles re-solvated in approximately thirty seconds. A similar test was conducted with the cartridge remaining decapped for two hours. In that case, the nozzles re-solvated in approximately sixty seconds.

Figure 9:
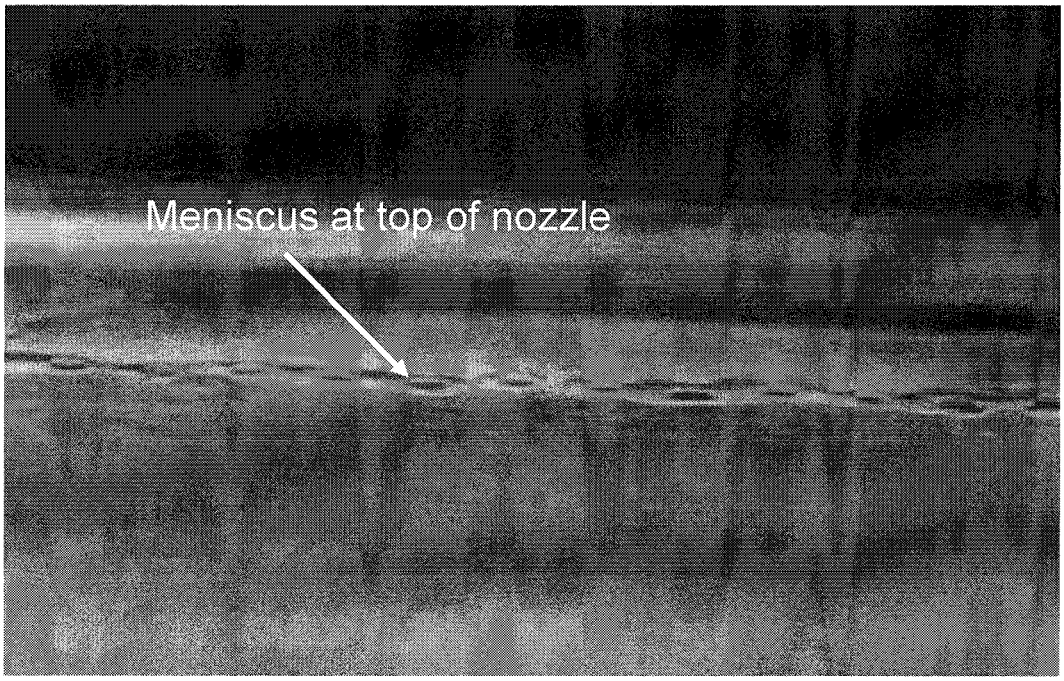
FIGS. 9 and 10 are photographs showing the oscillation or vibration of ink menisci in nozzles of a thermal inkjet printhead.
Figure 10:
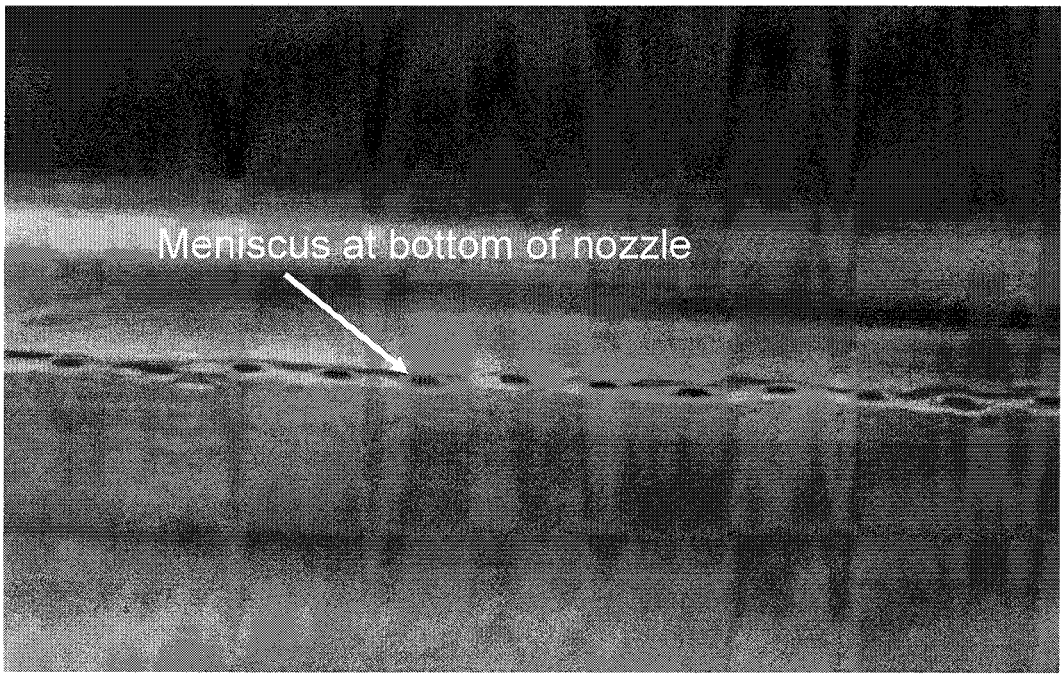

Using a strobed illumination source, it was possible to observe "snapshots" of the meniscus position in the nozzles. By delaying the illumination source with respect to the application of sonic energy, one could observe the meniscus in various positions, dependent upon the amount of delay. In this way, the fluid could be observed in positions that range from the bottom of the nozzle to the top of the nozzle, and even slightly bulging above the nozzle. FIGS. 9 and 10 are still photographs of a brief video of meniscus oscillation at the nozzles. More specifically, in FIG. 9 the ink menisci are at the top of or protruding from the nozzles; and, in FIG. 10 the ink menisci have retracted so the nozzles are visible.

Using the described video observations test setup described above, a range of frequencies from about 2.5 kHz to about 30 kHz vibration were evaluated, with each frequency creating meniscus oscillation. Vibrational energy at a frequency of about 2.0 KHz may also be effective. However, the frequency of meniscus oscillation does not match the input frequency. Instead, meniscus oscillation appeared to be fixed by the resonant frequency associated with the cartridge fluidic column architecture. That is, the oscillation can only proceed as fast as the fluidic column can move between the bulk ink source and the meniscus. While the meniscus of the fluidic column may vibrate, oscillate or modulate there may also occur some flooding around a localized region at a nozzle which may also aid in maintaining nozzle function.

In addition or alternatively, vibrational energy may be applied to the fluidic column during or when the printhead is performing a printing operation. Testing was conducted on cartridges containing an ink with a MEK or MEK with methanol solvent and having 40 μm×40 μm fluidic channel. The volume of ink in an ink reservoir providing ink to a printhead ranged from about 15 cc to about 45 cc. The printheads printed at print frequencies of 2 KHz and/or 8 KHz, and vibrational energy was applied to the fluidic columns at a frequency of 6 KHz and 10% amplitude.

Figure 11:
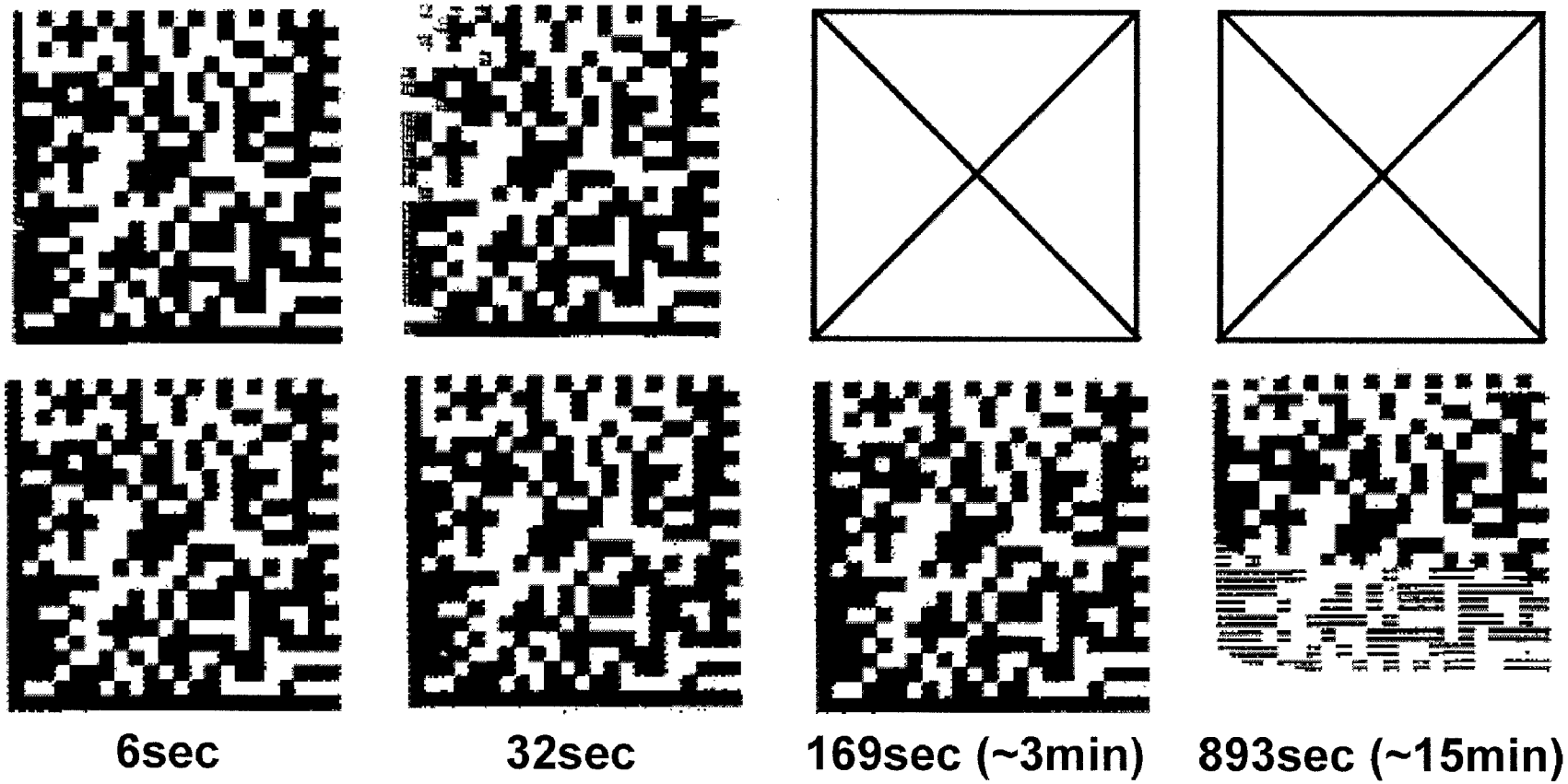
FIG. 11 provides print samples generated by cartridges to which vibrational energy was applied to fluidic columns compared to print samples generated by the same cartridges and for which vibrational energy was not applied.

Vibrational energy was applied continuously during printing operations and during intervals of printing inactivity. The intervals of printing inactivity between printing operations included 6 seconds, 32 seconds, 169 seconds (3 minutes) and 893 seconds (15 minutes). Print samples generated from these cartridges were compared to print samples from the same cartridges for which vibrational energy was not applied either during printing activity or during the same time intervals of printing inactivity. With respect to FIG. 11 there is shown a comparison of the print samples for the cartridges to which vibrational energy was applied below those print samples for which no vibrational energy was applied. The print samples in the top row are from those cartridges for which vibrational energy was not applied; and, print samples in the bottom row are from those cartridges to which vibrational energy was applied. At the 6 second time interval of printing inactivity the improvement of print quality was not statistically significant; however, at 32 second, 169 second and 893 second time intervals of printing inactivity, the print quality improved and was statistically significant. At the 169 and 893 second intervals of printing inactivity, the cartridges did not print when vibrational energy was not applied, which is represented by the X-marked boxes.

As described above, the frequency at which a meniscus may vibrate or oscillate and the time duration for application of a vibrational force necessary to maintain or recover nozzle function may vary among different cartridge types or ink types. Accordingly, the controller 29 may access a database 32 that includes data relative to the identity of a plurality of inkjet cartridge types and/or an identity of a plurality of ink types. In addition, the database 32 may include data relative to one or more frequencies or ranges of frequencies associated with each cartridge type and/or ink type, and a schedule of one or more timed intervals for activating the transducer 25 during a period of printing inactivity or during a printing operation. As described above certain parameters associated the cartridges may control the frequencies or range of frequencies selected to oscillate a fluidic column. For example, cartridge types may use different inks (i.e., water-based vs. solvent-based, or inks that differ in viscosity) or differ in fluidic column architecture. In addition, a selected printing mode for a cartridge or printing system may also affect the oscillation frequency ink in a fluidic column. For example, a draft print mode may have less stringent printing quality standards as a speed print mode; therefore, the ink in a fluidic column may be oscillated at a lower frequency or for a shorter period of time. Accordingly, the database 32 may include data relative to one or more frequencies or ranges of frequencies that are associated with one or more printing modes.

The cartridge 10 preferably has an identification circuit that generates a signal indicative of the cartridge type and/or ink type when the cartridge 10 is mounted in the pocket 26, and electrically interconnected with the controller 29. In this manner, the controller 29 is configured access the database 32 to select a frequency or range of frequencies associated, one or more time duration for activation, with the cartridge to control the activation of the transducer 25 to maintain or recover nozzle function of the cartridge 10 during periods of printing inactivity or during printing operations.

The printing system may also include a closed loop system that continuously monitors nozzle function using optical sensors or other sensing systems for detecting whether ink is being ejected from the printhead. Such optical sensors are known to those skilled in the art and may include one or more through beam sensors that detect an ink drop that passes through a light beam. Another optical system may incorporate sensors that detect ink drops or spots printed on a medium according to a predetermined image and responsive to a print command. In addition, electrostatic systems may utilize an electrical charge plate that displays certain electrical properties according to a predetermined image printed on the plate. In the above examples, responsive to a print command, nozzles are selected or predetermined through which ink drops are ejected for printing. One or more sensors are provided to determine whether ink drops are ejected through a nozzle according to the print command. When a nozzle does not fire on demand, a sensor transmits a signal to the controller 29; responsive to which the controller 29 may activate the transducer 25 to initiate a nozzle recovery mode to unplug the nozzle.

While the preferred embodiments of the present invention have been shown and described herein, it will be obvious that such embodiments are provided by way of example only and not of limitation. Numerous variations, changes and substitutions will occur to those skilled in the art without departing from the teaching of the present invention. For example the transducer may be mounted internally of the cartridge and/or included as a component of the printhead. Accordingly, it is intended that the invention be interpreted within the full spirit and scope of the appended claims.

What is claimed is:

1. An thermal inkjet printing system, comprising:

a printhead having a plurality of nozzles with each nozzle being associated with an ink ejection chamber in which ink is stored for ejecting ink drops from the chamber through the nozzle;

an ink fluidic column for each nozzle comprising at least ink in the ejection chamber;

an inkjet cartridge including the printhead in fluid communication with an ink supply, the inkjet cartridge mountable on the printing system for printing on a print medium;

a transducer for transmitting vibrational energy to a plurality of the fluidic columns to simultaneously vibrate at least a portion of each of a plurality of the ink fluidic columns; and, a controller that generates a signal to activate the transducer.

2. The inkjet printing system of claim 1, wherein the fluidic column associated with each nozzle includes a meniscus and the meniscus in each nozzle for a plurality of the nozzles is simultaneously vibrated when the vibrational energy is transmitted to the fluidic columns.

3. The inkjet printing system of claim 1, wherein the transducer transmits the vibrational energy from a location exterior of the cartridge.

4. The inkjet printing system of claim 1, wherein the transducer transmits the vibrational energy from a location interior of the cartridge.

5. The inkjet printing system of claim 1, wherein the transducer is integrated as a component of a printhead circuit.

6. The inkjet printing system of claim 1, wherein the transducer transmits the vibrational energy to the fluidic columns during a printing operation.

7. The inkjet printing system of claim 1, wherein the transducer transmits the vibrational energy to the fluidic columns during a period of printing inactivity.

8. The inkjet printing system of claim 7, wherein the transducer transmits sonic energy for a continuous uninterrupted time period beginning immediately after a printing operation has been completed and up to when a printing command is generated by the controller.

9. The inkjet printing system of claim 1, further comprising a pocket within which the inkjet cartridge is mounted for printing, the transducer disposed in contact with the pocket, and the vibrational energy is transmitted through the pocket and cartridge to a plurality of the fluidic columns.

10. The inkjet printing system of claim 1, wherein the transducer applies a vibrational force directly to an area on an external surface of the cartridge so the vibrational energy is transmitted through the cartridge to a plurality of the fluidic columns.

11. The inkjet printing system of claim 10, wherein the transducer applies the vibrational force to the printhead.

12. The inkjet printing system of claim 10, wherein the transducer applies the vibrational force to an area on cartridge that is not an area defined by the printhead.

13. The inkjet printing system of claim 1, wherein the vibrational energy is generated by the transmission of sonic and ultrasonic energy at frequencies ranging from about 2.0 kHz to about 30 kHz.

14. The inkjet printing system of claim 1, wherein the controller generates signals for initiating printing commands and generates the signals to activate the transducer.

15. A thermal inkjet printing system utilizing one or more thermal inkjet cartridges for printing, comprising:

an inkjet cartridge having a printhead in fluid communication with an ink supply, with the inkjet cartridge being mountable on a printing system for printing on a print medium;

the printhead comprising a nozzle plate mounted to a printhead substrate and having a plurality of nozzles, with the substrate having a plurality of firing chambers formed thereon and each in fluid communication with the ink supply, and each firing chamber being associated with a nozzle, and ink drops are ejected through the nozzles in drops as a result of the ink being heated in the firing chamber in response to print commands from a controller;

an ink fluidic column associated with each nozzle comprising at least ink in the firing chamber for each nozzle;

a transducer for transmitting vibrational energy to the fluidic column to vibrate at least a portion of one or more of the ink fluidic columns, wherein the transducer is positioned on the printing system at a location external of the cartridge; and, a controller that generates a signal to activate the transducer.

16. The thermal inkjet printing system of claim 15, wherein the fluidic column associated with each nozzle includes a meniscus and the meniscus in each nozzle for a plurality of the nozzles is simultaneously vibrated when the vibrational energy is transmitted to the fluidic columns.

17. The thermal inkjet printing system of claim 15, wherein the transducer transmits the vibrational energy to a plurality of the fluidic columns simultaneously vibrating a plurality of the fluidic columns.

18. The thermal inkjet printing system of claim 15, wherein the transducer applies a vibrational force to the printhead to transmit the vibrational energy to the fluidic columns.

19. The thermal inkjet printing system of claim 15, wherein the cartridge comprises a cartridge housing within which the ink supply is contained.

20. The thermal inkjet printing system of claim 15, wherein the cartridge further comprises a printhead assembly including a snout on which the printhead is mounted and the vibrational force is applied to an area on the snout thereby transmitting the vibrational energy to the fluidic columns.

21. The thermal inkjet printing system of claim 15, wherein the cartridge further comprises a printhead assembly including a snout on which the printhead is mounted, the cartridge is mounted in a pocket of the printing system and the transducer is disposed in contact with the pocket and applies a vibrational force to a portion of the pocket that contacts at least a portion of the snout.

22. The thermal inkjet printing system of claim 15, wherein the printhead includes an ink slot formed therein through which ink from the ink supply passes to the firing chambers and the printhead further comprising a plurality of fluid channels each in fluid communication with the ink slot and each associated with a firing chamber and disposed between the ink slot and firing chamber for supplying ink to the firing chamber and the fluidic column includes ink in the nozzle, firing chamber, fluid channel and ink slot.

23. A method for maintaining or recovering nozzle function for a printhead in an inkjet printing system, comprising:

providing an inkjet cartridge having a printhead in fluid communication with an ink supply, and the printhead having a plurality nozzles and for each nozzle there is an ink fluidic column including a meniscus and ink in an ejection chamber; and, vibrating at least a portion of one or more of the ink fluidic columns by transmitting vibrational energy to the plurality of the ink fluidic columns through a pocket within which the inkjet cartridge is mounted for printing.

24. The method of claim 23, wherein vibrating the ink fluidic column comprises applying a vibrational force to an external surface of the inkjet cartridge.

25. The method of claim 23, wherein the vibrational force is applied to the printhead.

26. The method of claim 23, wherein the vibrating step comprises transmitting the vibrational energy to the fluidic columns during a printing operation.

27. The method of claim 23, wherein the vibrating step comprises transmitting the vibrational energy to the fluidic columns during a period of printing inactivity.

28. The method of claim 23, wherein the vibrating step comprises transmitting sonic or ultrasonic energy for a continuous uninterrupted time period beginning immediately after a printing operation has been completed and up to when a printing command is generated by the controller.

29. The method of claim 23, further comprising the step of providing a predetermined frequency or predetermined range of frequencies at which the fluidic column for an inkjet cartridge will vibrate responsive to the transmission of the vibrational energy.

30. The method of claim 23, further comprising identifying the inkjet cartridge mounted in the printing system, providing in a database one or more frequencies or range of frequencies at which the menisci will vibrate for the identified cartridges and transmitting the vibrational energy at the one or more frequencies selected from the database.

31. The method of claim 23, further comprising providing a database that includes data relative to the identification of a plurality of different types of inkjet cartridges and data relative to one or more frequencies or ranges of frequencies associated with each inkjet cartridge type, selecting the one or more frequencies or ranges of frequencies associated with an inkjet cartridge type and transmitting the vibrational energy to the fluidic columns of an identified inkjet cartridge type at the selected one or frequencies or frequency ranges.

32. The method of claim 23, further comprising providing a database that includes data relative to the identification of a plurality of different types of inkjet cartridges and data relative to one or more amplitudes or ranges of amplitudes associated with each inkjet cartridge type, selecting the one or more amplitudes or ranges of amplitudes associated with an inkjet cartridge type and transmitting the vibrational energy to the fluidic columns of an identified inkjet cartridge type at the selected one or more amplitudes or amplitude ranges.

33. The method of claim 23, further comprising providing a database that includes data relative to the identification of a plurality of different types of inkjet cartridges and data relative to one or more time durations or ranges of time durations associated with each inkjet cartridge type, selecting the one or more time durations or ranges of time durations associated with an inkjet cartridge type and transmitting the vibrational energy to the fluidic columns of an identified inkjet cartridge type for the selected one or more time durations or ranges of time durations.

34. The method of claim 23, further comprising providing a database that includes data relative to the identification of a plurality of different types of ink and data relative to one or more frequencies or ranges of frequencies associated with each ink type, selecting the one or more frequencies or ranges of frequencies associated with an ink type and transmitting the vibrational energy to the fluidic columns of a printhead using an identified ink type at the selected one or frequencies or frequency ranges.

35. The method of claim 23, further comprising providing a database that includes data relative to the identification of a plurality of different types of ink cartridges and data relative to one or more amplitudes or ranges of amplitudes associated with each ink type, selecting the one or more amplitudes or ranges of amplitudes associated with an ink type and transmitting the vibrational energy to the fluidic columns of printhead using an indentified ink type at the selected one or more amplitudes or amplitude ranges.

36. The method of claim 23, further comprising providing a database that includes data relative to the identification of a plurality of different types of ink cartridges and data relative to one or more time durations or ranges of time durations associated with each ink type, selecting the one or more time durations or ranges of time durations associated with an ink type and transmitting the vibrational energy to the fluidic columns of a printhead using an identified ink type for the selected one or more time durations or ranges of time durations.

37. The method of claim 23, further comprising providing one or more sensors to detect whether ink drops are ejected through one or more nozzles responsive to a print command, transmitting a signal to a controller when one or more ink drops are not ejected through the nozzles in response to the print command, and vibrating at least a portion of the fluidic column in each of a plurality of the nozzles responsive to the signal transmitted by the sensor.

* * * * *